US010247065B2

(12) United States Patent
Mercier

(10) Patent No.: US 10,247,065 B2
(45) Date of Patent: Apr. 2, 2019

(54) TWO-STROKE INTERNAL COMBUSTION ENGINE WITH CRANKCASE LUBRICATION SYSTEM

(71) Applicant: Cesar Mercier, Roseland, NJ (US)

(72) Inventor: Cesar Mercier, Roseland, NJ (US)

( * ) Notice: Subject to any disclaimer, the term of this patent is extended or adjusted under 35 U.S.C. 154(b) by 34 days.

(21) Appl. No.: 15/186,488

(22) Filed: Jun. 19, 2016

(65) Prior Publication Data

US 2017/0362972 A1 Dec. 21, 2017
US 2018/0347415 A9 Dec. 6, 2018

Related U.S. Application Data

(60) Provisional application No. 62/182,165, filed on Jun. 19, 2015.

(51) Int. Cl.

| | |
|---|---|
| ***F01M 1/02*** | (2006.01) |
| ***F02B 75/32*** | (2006.01) |
| ***F02M 35/10*** | (2006.01) |
| ***F01M 11/00*** | (2006.01) |
| ***F02P 5/06*** | (2006.01) |
| ***F02P 3/02*** | (2006.01) |
| ***F02B 33/12*** | (2006.01) |
| ***F02B 33/16*** | (2006.01) |
| ***F01B 7/20*** | (2006.01) |
| ***F02B 75/30*** | (2006.01) |

(Continued)

(52) U.S. Cl.

CPC ..... *F01M 1/02* (2013.01); *F01B 7/20* (2013.01); *F01M 11/0004* (2013.01); *F01M 11/065* (2013.01); *F02B 33/12* (2013.01); *F02B 33/16* (2013.01); *F02B 75/30* (2013.01); *F02B 75/32* (2013.01); *F02M 35/10255* (2013.01); *F02P 3/02* (2013.01); *F02P 5/06* (2013.01); *F01M 2001/0238* (2013.01); *F01M 2011/007* (2013.01); *F02B 2075/025* (2013.01)

(58) Field of Classification Search

CPC ..... F01M 1/02; F01M 11/0004; F01M 2011/007; F01M 2001/0238; F02P 3/02; F02P 5/06; F02M 35/10255; F02B 75/02; F02B 75/32; F02B 2075/025

See application file for complete search history.

(56) References Cited

U.S. PATENT DOCUMENTS 3,973,393 A * 8/1976 Vogelsang ..... F02G 1/02 123/41.37
4,592,309 A * 6/1986 Williams ..... F01B 9/06 123/56.7

(Continued)

*Primary Examiner* — Michael C Zarroli

(57) ABSTRACT

A two-cycle internal combustion engine with rear compression chamber, other than that of a crank case. This present engine has valves that can be screwed on the engine block near top dead center, and is actuated by air pressure. This present two-cycle engine uses an oil sump similar to that of a four-cycle engine, which eliminates the need to premix oil with the fuel. This present engine has a stationary piston which operates within a movable piston to form a rear-compression chamber. The movable piston has ports near its crown to transfer charge to the combustion chamber. The movable piston also has ports near bottom of its skirt to allow the fuel and air mixture to enter the rear compression chamber. This engine has a piston seat which is adapted to connect the movable piston to the connecting rod.

6 Claims, 10 Drawing Sheets

(51) Int. Cl.
*F01M 11/06* (2006.01)
*F02B 75/02* (2006.01)

(56) References Cited

U.S. PATENT DOCUMENTS 6,397,579 B1 * 6/2002 Negre ..... F02B 41/06
60/39.6
7,503,290 B2 * 3/2009 Skulic ..... F02B 25/08
123/51 B
8,215,268 B2 * 7/2012 Barberato ..... F02B 75/28
123/197.1

* cited by examiner

SECTION B-B

TWO-STROKE INTERNAL COMBUSTION ENGINE WITH CRANKCASE LUBRICATION SYSTEM

RELATED APPLICATION

This patent application is related to U.S. Provisional Patent Application No. 62/182,165 filed by applicant Cesar Mercier on Jun. 19, 2015, and claims the benefit of that filing date.

BACKGROUND OF THE INVENTION

A conventional two-stroke engine requires oil to be pre-mixed with the fuel in order to lubricate moving components of the engine. The crankcase has to be sealed as a result. This prevents a two-stroke engine from sharing a crankcase. U.S. Pat. No. 4,450,794 and U.S. Pat. No. 4,791,892, titled "Two-stroke engine", filed by Roger M. Hall, are good examples of this problem.

A conventional two-stroke engine has transfer ports near bottom dead center which causes some of the fuel to exit the combustion chamber with the exhaust. Complex expansion chambers have helped to solve this problem, but the solution has not work efficiently across the speed range of the engine.

A conventional two-stroke engine has a long piston skirt which often brushes against the cylinder. The reaction force from the piston rod causes the piston to move sideways while the crank shaft is about 45 degree from top dead center.

SUMMARY OF THE INVENTION

It is an object of this invention to provide a two-stroke engine with a separate lubrication system that works substantially identical to a four-stroke, whereas no need to pre-mix fuel and oil in order to lubricate moving parts.

It is another object of this invention to provide a two-stroke engine with rear compression.

It is another object of this invention to provide a two-stroke engine with side thrust management for the piston against the throw of the rods.

It is another object of this invention to provide a modular two-stroke engine that can be combined to form a variety of shapes not limited to radial engine configuration, V shape or flat in-line cylinder configuration, sharing a crank case.

It is another object of this invention to provide a two-stroke engine that does not need an exhaust expansion chamber to prevent fresh fuel and air mixture from leaving the combustion chamber.

It is another object of this invention to provide a two-stroke engine with a screw-in intake valve assembly.

It is another object of this invention to provide a two-stroke engine with inlet valves actuated by compressed air to open and close respectively during operation, without the need for springs.

It is another object of this invention to provide a two-stroke engine with inlet valves actuated by compressed air to open the valve and magnetic force to close the valve during normal operation, without the need for springs.

It is another object of this invention to provide a two-stroke engine with a 360 degree oil pickup, allowing the engine to run with adequate lubrication in any position.

It is another object of this invention to provide a two-stroke engine with dynamic spark advance feature not controlled by electronics.

It is another object of this invention to provide a two-stroke without reed valves.

It is another object of this invention to provide a two-stroke engine that is easy to manufacturer with straight holes and simple shapes that can be mass produced without the need for sand mold casting.

The present two-stroke engine does not require oil to be mixed with engine fuel/air mixture in order to lubricate moving components. The lubrication system is identical to that of a four-stroke engine whereas an oil pump is used to suck oil from an oil sump to lubricate all moving parts.

The present two-stroke engine has a rear compression chamber where at least some part of the charge is compressed by the engine working piston on its downstroke in a volume other than that of the engine crankcase. The present two-stroke engine uses straight passages or holes within the cylinder to deliver fresh charge to the combustion chamber. These straight passages allow for ease of manufacturing.

The present two-stroke engine uses screw-in intake valve to ease manufacturing, troubleshooting and repair. The intake charge enters the combustion chamber behind the exhaust and near top dead center while the exhaust ports are near bottom dead center. The preferred embodiment uses a plurality of exhaust ports near bottom dead center, allowing manufacturers to retrieve maximum torque or horsepower. Wide and short exhaust ports allows for longer combustion which provides more torque. Wide and tall exhaust ports allows for shorter combustion and higher speed and horsepower.

The present engine has an oil sump that allows oil to be picked up by the oil pump regardless of the position of the engine. The oil suction head moves with the oil due to gravity.

The present engine is a two-stroke engine comprising: a stationary cylinder and engine block, at least one intake valve, a movable piston functioning within the said cylinder forming a combustion chamber, a stationary piston functioning within the said movable piston, forming a rear compression chamber, a shaft attached to at least one rod, a piston seat adapted to link the movable piston to the rods wherein at least one top port is located near the crown of the movable piston, and wherein at least one bottom port is located near bottom of the movable piston skirt, wherein the said at least one bottom port is open to allow fresh fuel/air mixture to enter the rear compression chamber to be compressed when the movable piston is near Top Dead Center, wherein at least one top port is open when the movable piston is near Bottom Dead Center to push the compressed air or air/fuel mixture through transfer ports or inlet valve into the combustion chamber, wherein the fuel mixture is ignited during compression stroke to push the piston down during power stroke, wherein exhaust leaves the combustion chamber through exhaust ports located on the cylinder near bottom dead center. At least one two-stroke conventional transfer port may be used in conjunction or in lieu of at least one intake valve.

The present engine has an intake valve near top dead center or cylinder head, and actuated by compressed air or fuel/air charge from a two-stroke rear compression chamber. The intake valve may be machined within the engine block near top dead center. The intake valve assembly is screwed into the combustion chamber to ease manufacturing process, troubleshooting and repair, and to eliminate the need for an extra piston head component. The valve assembly is made of two chambers with a valve guide serves as a divider as well.

The present engine has a mechanism for transferring reactive force from piston rods to the engine block comprising: a piston seat linking the movable piston to the rods, at least one rod linking engine shaft to a piston seat wherein at least one bearing is mounted on the piston seat and is adapted to directly or indirectly glide on the engine block in order to redirect the force from the rods normally applied on conventional pistons skirts to the engine block instead. The piston seat is a multi-function one piece component made with bearing materials to glide on the engine block directly or indirectly. The piston seat may be made of other materials by mounting another bearing on the seat to glide against another bearing on the engine block or on the engine block itself.

The present engine has an oil pump comprising: a bearing mounted on a piston seat, a bearing mounted on engine block, at least one check valve, wherein the bearing mounted on the piston seat and the bearing mounted on the engine block form a closed cylinder with a cavity leading to at least one check valve, wherein the piston seat moves with the piston to expand and contract the volume within the said closed cylinder, wherein the at least one check valve is used to allow oil to be sucked in the cylinder during expansion, and to allow oil to be pushed out to another channel during contraction of the volume within the closed cylinder. These two bearing are kept sealed by the reaction force of the rod.

The present engine has an oil sump system that allows oil to be sucked into an oil pump regardless of the engine body and oil sump rotation comprising: a substantially cylindrical oil sump, a propeller blade mounted on the shaft, a component functioning like an oil pipe pivoting about the axis of the said oil sump, a rotatable suction head component mounted on the oil pipe component is adapted to be emerged in the oil sump wherein oil is sucked from the said suction head through the said oil pipe leading to the oil pump, wherein the said suction head rotates in all direction with oil in the sump due to gravity in order to suck oil, wherein the said propeller is mounted or carved on the engine shaft, and is located at about opposite side from the said oil sump, wherein the said propeller shoots oil back up into the said oil sump when the latter is in up position.

The present engine has a spark advance mechanism comprising: at least one magneto mounted on a bracket pivoting about the axis of the shaft of an engine, a governor, at least one spark plug, a screw or means for adjusting the angle of the said bracket default location, a spring to return the bracket to its default location wherein the said governor turns the bracket supporting the at least one magneto to advance or delay the firing of the at least one spark plug as the engine speed changes.

REFERENCE NUMERALS

Number Description

Figure 1:
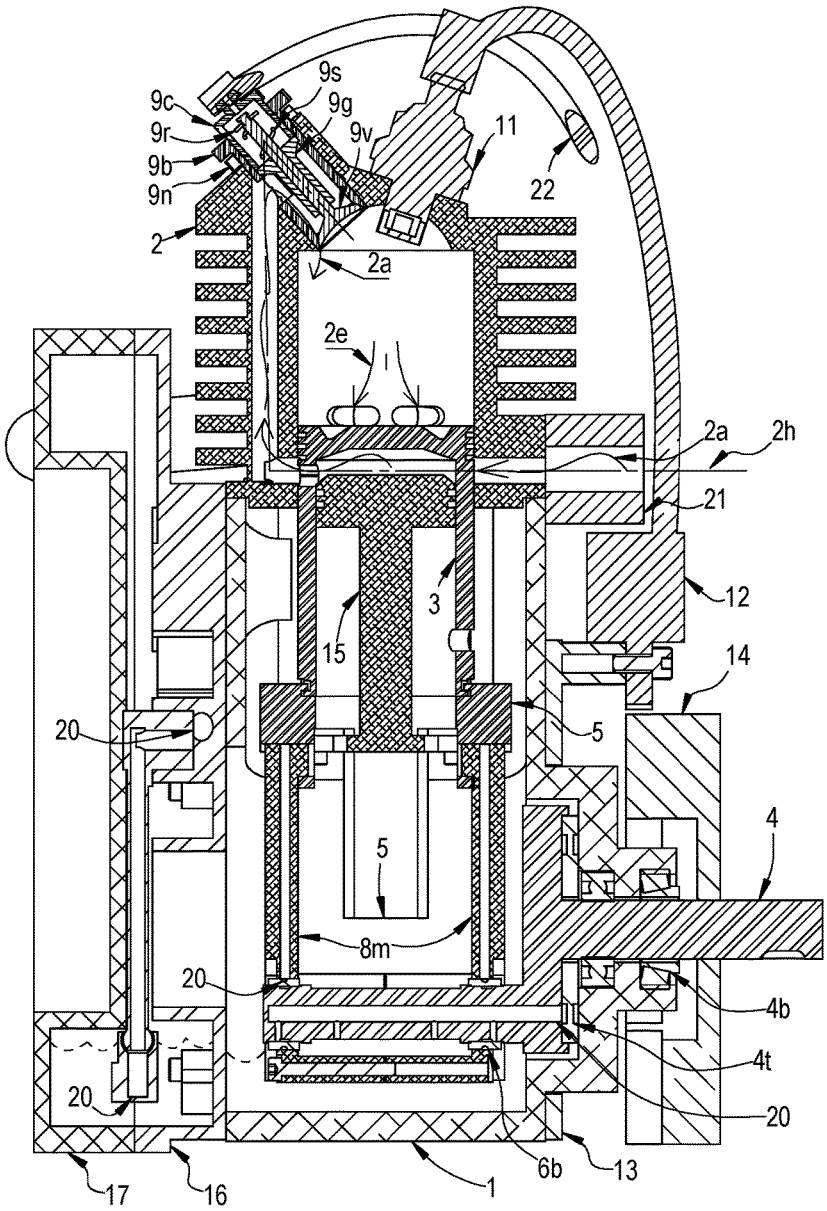
FIG. 1 shows a side sectional view of a two-stroke engine.

1 A one-cylinder two-stroke engine block
1*r* A multi-cylinder two-stroke engine block
2 A two-stroke cylinder component.
3 A piston
4 A shaft
4*b* A shaft bearing
4*t* A thrust bearing
5 A multi-function piston seat and oil pump body.
6*b* A rod bearing
7 An oil pump bearing
8 A rod assembly coupled with engine shaft
8*m* A piston rod.
9 An intake valve assembly
9*c* An intake valve housing cover
9*r* An intake valve retainer
9*s* An intake valve spring
9*g* An intake valve guide
9*b* An intake valve body
9*n* An intake valve height adjusting nut
9*v* An intake valve
11 A sparkplug
12 A magneto
13 A spark advance magneto support wheel
14 A flywheel
15 Stationary piston
16 Oil sump
17 Oil sump cover
18 Oil suction head
19 Oil suction pipe component
20 Oil passages gallery
21 Carburetor
22 Oil hoses
23 Oil hose fittings
24 Oil valve
25 Oil valve spring

DETAILED DESCRIPTION OF THE PREFERRED EMBODIMENTS

Figure 2:
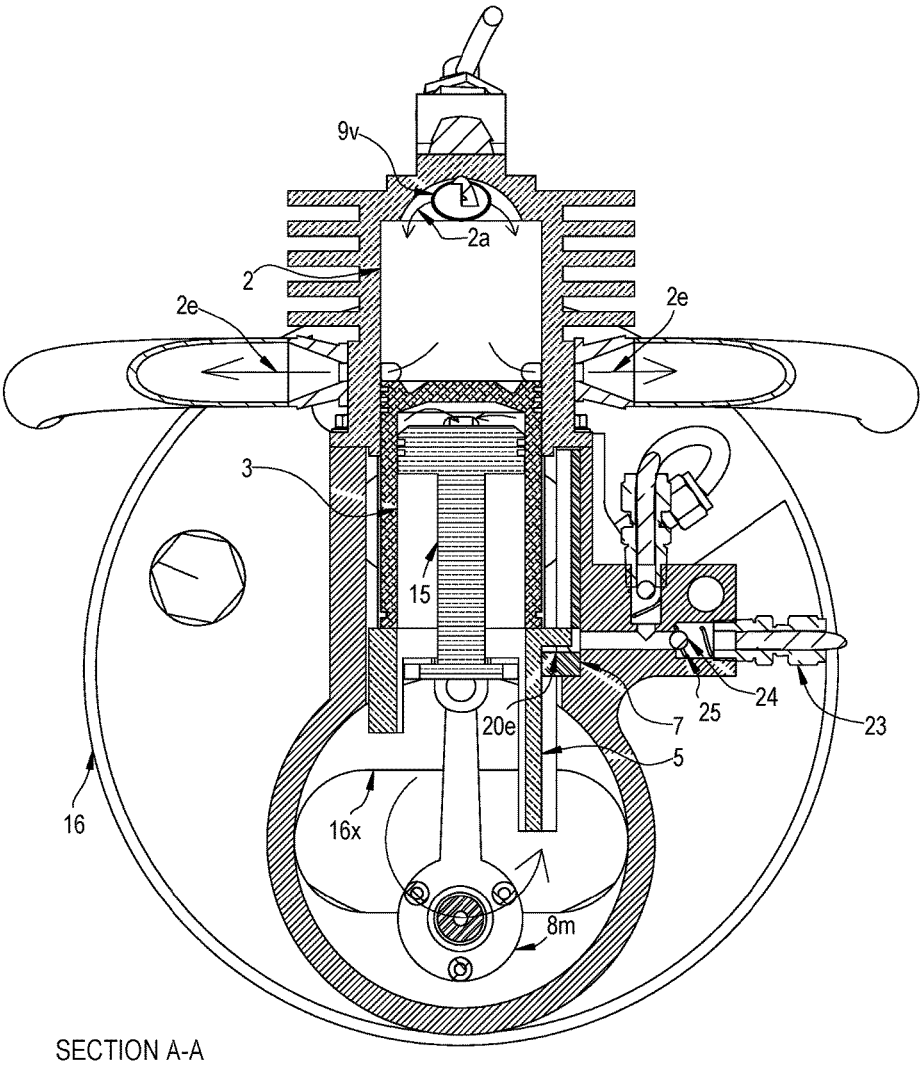
FIG. 2 shows a front sectional view of a two-stroke engine.
Figure 8A:
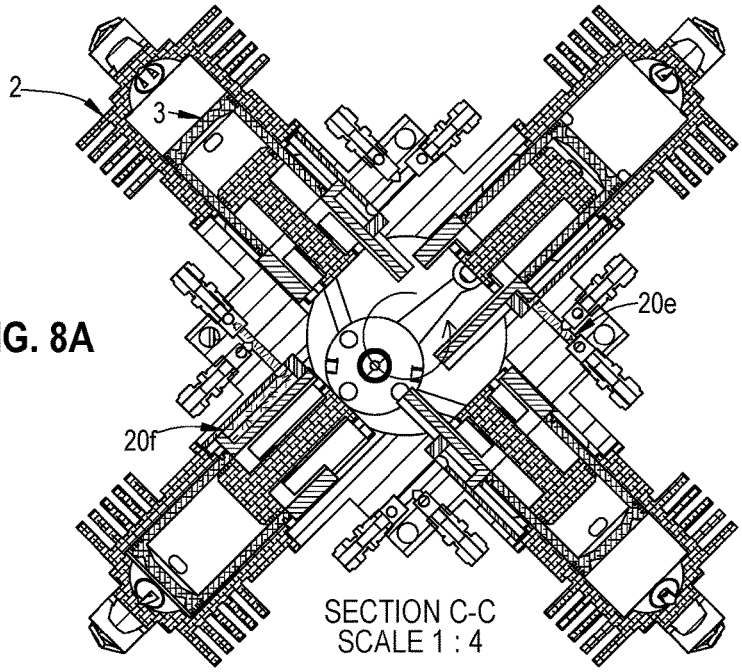
FIG. 8A shows a front sectional view of a two-stroke radial engine and piston locations during stroke cycles.

A cross section of a two-stroke single cylinder engine in accordance with the present invention is depicted in FIG. 1 and FIG. 2. The engine may be constructed with a plurality of cylinders as depicted in FIG. 8A.

Figure 4B:
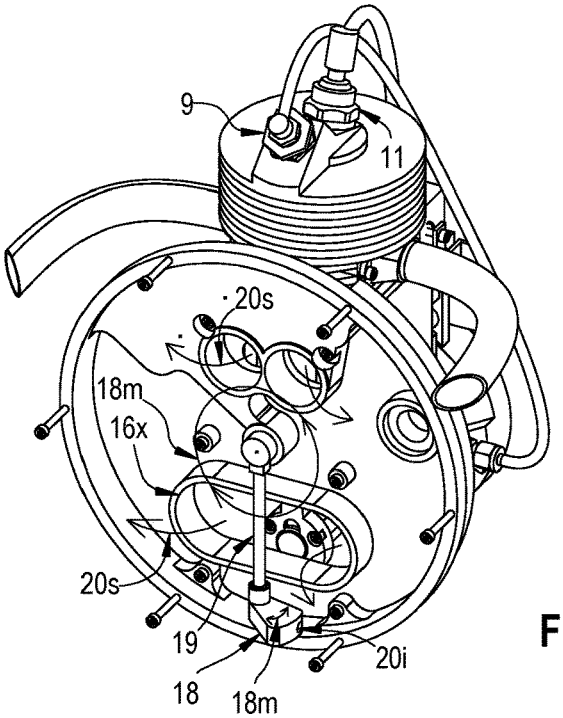
FIG. 4B shows an isometric view of a two-stroke engine with its oil sump cover removed to depict a 360 degree oil pickup mechanism.
Figure 5:
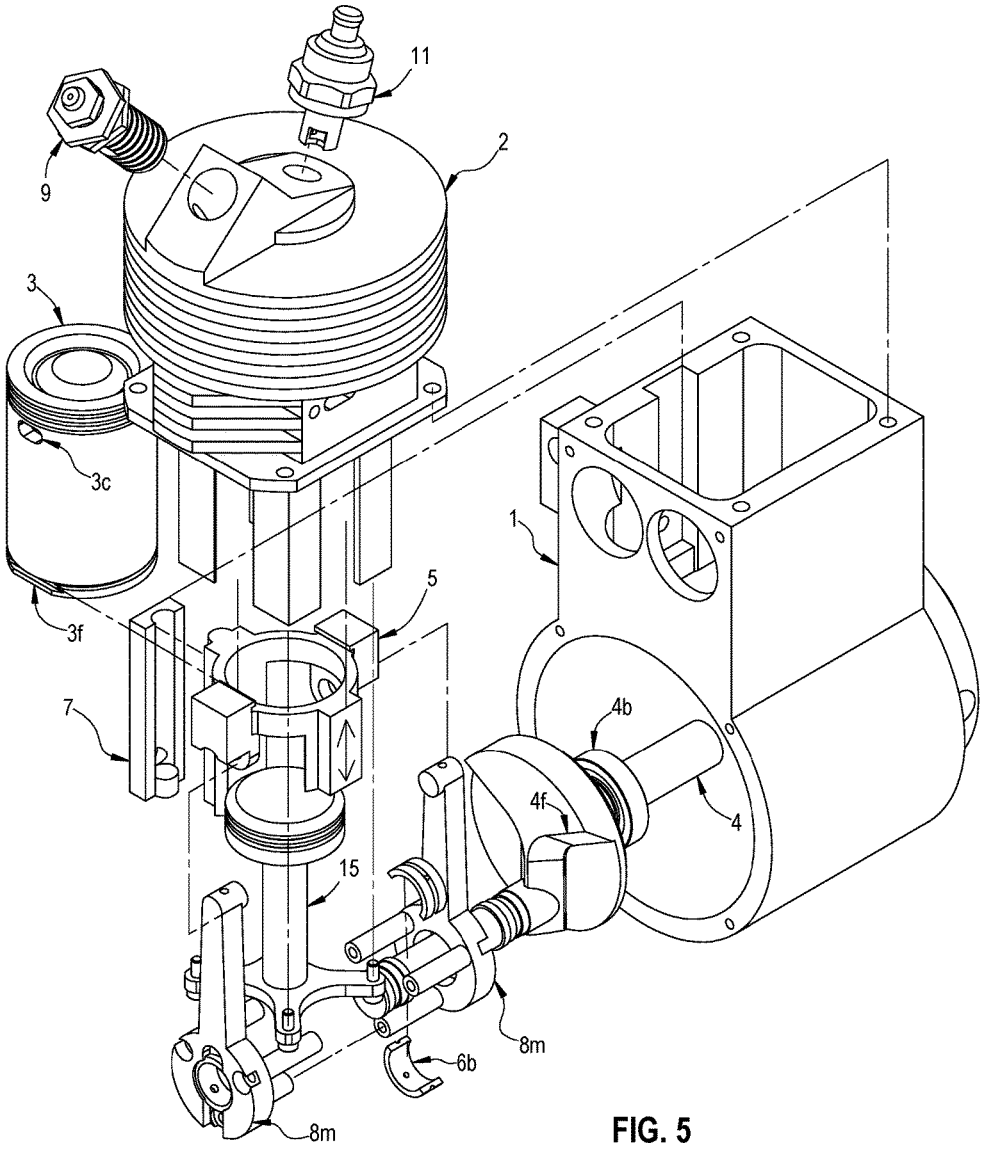
FIG. 5 shows an exploded view of a one cylinder two-stroke engine.
Figure 8B:
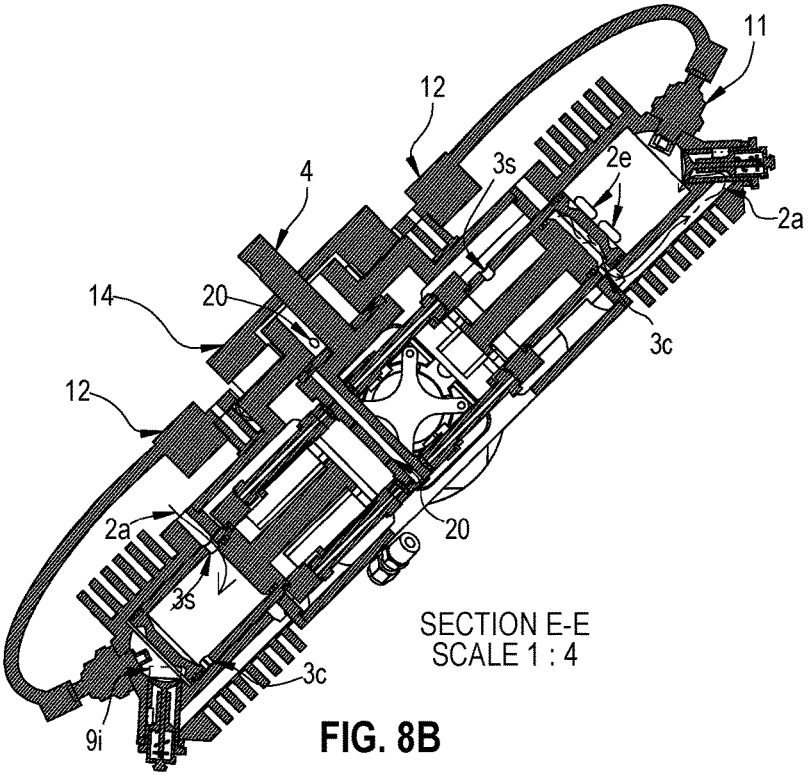
FIG. 8B shows a side sectional view of a two-stroke radial engine.

Referring to FIG. 1, a piston 3 is movably mounted within a cylinder 2 forming a combustion chamber. A stationary piston 15 is adapted to function within the movable piston 3 forming a rear compression chamber. The stationary piston 15 is secured on cylinder 2 in this preferred embodiment as further shown in FIG. 5. Piston 15 may also be secured on the engine block or any other component that can provide adequate support. Piston 15 is used to create a sealed chamber with inlet bottom ports and outlet top ports on and underneath piston 3. A piston seat 5 is adapted to link the piston 3 to the piston rods 8*m*. The piston seat 5 is a multi-function component that is also used as part of an oil pump. Another function of seat 5 is to safely transfer reactive torque of the piston rods to the engine block 1. This configuration prevents the piston skirt from scraping the cylinder wall. A rod bearing 6*b* is mounted within the rods 8*m* and on engine shaft 4. The rods are attached together forming one rod assembly as further depicted in FIG. 5. A thrust bearing 4*t* is adapted with cavities to allow oil to travel from oil sump 16 to lubricate moving surfaces via oil gallery 20. Hose 22 is used to distribute oil to and from oil pump. An oil sump cover 17 is shaped to channel oil to an oil pickup head 19 as illustrated in FIG. 4B. A main shaft bearing 4*b* is used to secure the shaft within the engine block. A magnet is mounted on flywheel 14 to work in conjunction with a magneto 12 to power a spark plug 11. Air intake 2*a* goes through a carburetor 21, then through bottom ports 3*s* on piston 3 as illustrated in FIG. 8B, then through cavity in cylinder 2, to finally push open intake valve 9*v* to enter the combustion chamber as soon as pressure difference occurs while the piston is near bottom dead center (BDC). One or more ports are located on and near movable piston crown. Plus, one or more ports are located near bottom of piston 3, on different faces of the piston 3. This configuration allows for fuel/air mixture to enter the sealed chamber underneath piston 3, through the bottom ports 3*s*, and while piston 3 is about Top Dead Center (TDC). As piston 3 starts going down towards BDC, the intake port is closed and the fuel mixture starts to be compressed. When piston 3 reaches near BDC, outlet top port 3*c*, as illustrated in FIG. 5, is open facing the cavity within cylinder 2, and the compressed charge enters the combustion chamber through intake valve 9*v*. Conventional two-stroke transfer ports may also be used to transfer compressed fuel/air mixture to enter the combustion chamber from this piston in piston configuration. The inlet and outlet cavities within the cylinder 2 are straight intersecting holes to ease manufacturing process. A plurality of ports or valves may be mounted in the stationary piston to channel air flow from the carburetor to the combustion chamber. A plurality of exhaust ports is located at BDC to facilitate exhaust 2*e* to exit the cylinder at the right time to achieve the desired torque or horsepower. Engine manufacturers can use the location, the width and the height of the exhaust ports to adjust engine power to produce optimum torque or horsepower. The intake charge enters the combustion chamber after the exhaust ports have been opened and combustion chamber pressure drops below that of the intake charge pressure. The exhaust ports are closed before the intake charge gets the chance to reach the exhaust ports due to long distance and time constraint. The novel configuration of a movable piston seat coupled with a stationary piston allows for a compact engine module that has a rear compression chamber while allowing all moving parts to be lubricated. This configuration coupled with the top and bottom ports on the piston allows for a simple engine that eliminates the need for a reed valve. Line 2*h* illustrates a specific way of drilling holes within the cylinder to connect cavities for air passages in a way that eliminates the need for a separate cylinder head while allowing air to go through a screw-able valve assembly. This configuration also allows for a prolonged valve seat with a cavity facing the line 2*h* to be secured on top of the cylinder by nut 9*n*. In a preferred embodiment, an air pump is actuated by the piston seat so that air is sucked in the pump as the piston seat travels towards bottom dead center, and air is compressed and pushed on the valve spring retainer 9*r* through air ports on the valve body between valve guide 9*g* and component 9*r* which is adapted to seal air in this chamber to close the valve as the piston moves towards top dead center. The spring 9*s* can therefore be removed to allow the engine to run at very high speed.

Referring to FIG. 2, a front sectional view of the two-stroke engine depicting an oil pump made of two bearings forming a cylinder like syringe split in half. One half 5 is the piston seat; the other half is a bearing 7 mounted in the engine block. Two check valves 24 and springs 25 are used to allow oil from the oil sump to be sucked into the pump via one of the one-way valves, then be pushed out to the engine block via the other one-way valve and fittings 23. This view also illustrates air charge 2*a* entering the combustion chamber while exhaust 2*e* leaving the combustion chamber. Oil fitting 23 is used to channel oil from the oil sump 16 to lubricate moving components.

Figure 3A:
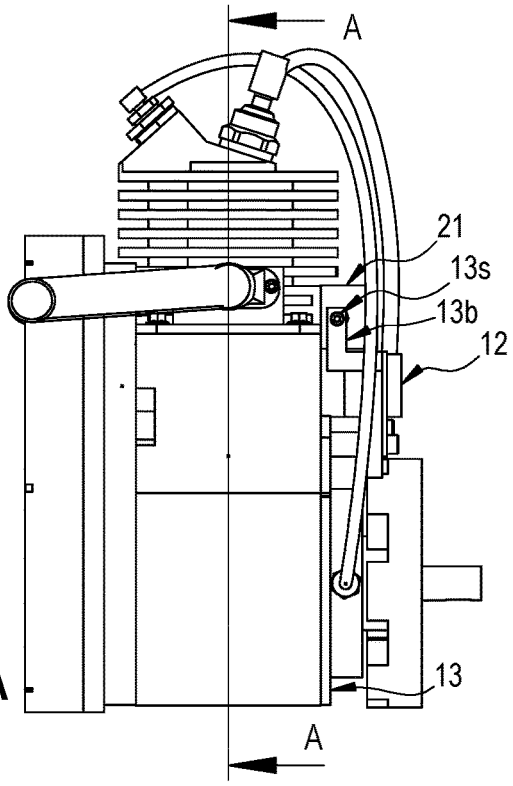
FIG. 3A shows a side view of a two-stroke engine.

FIG. 3A is a side view of the engine which also illustrates the magneto 12 mounted on a rotatable cylindrical bracket 13 actuated by a governor forming a spark advance wheel mechanism. Another bracket 13*b* is mounted on the magneto wheel 13 and bolt 13*b* is used to adjust the location of the magneto. When the engine speeds up, the governor turns bracket 13, which is further illustrated in FIG. 9, to control when the magneto should energize sparkplug 11. One or more bolts is used to adjust the default location of bracket 13 at idle and or at maximum engine speed.

Figure 3B:
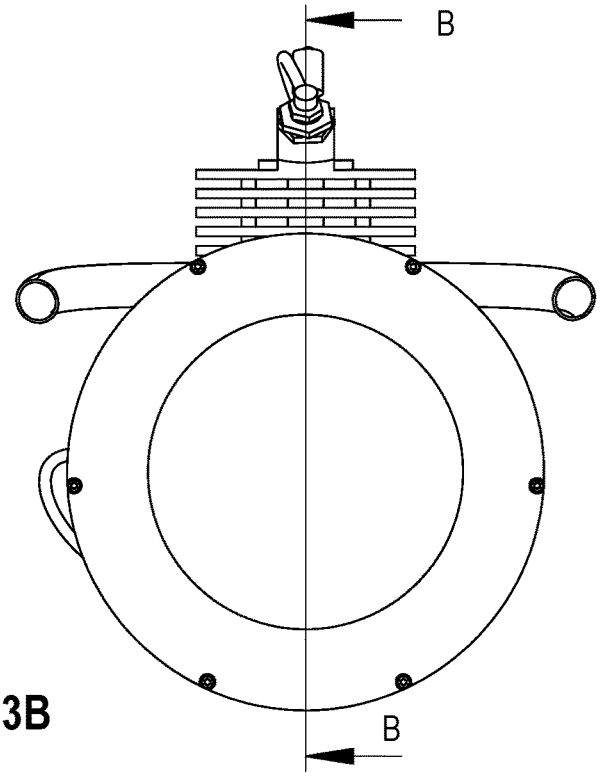
FIG. 3B shows a front view of a two-stroke engine.

FIG. 3B is a front view of the engine.

Figure 4A:
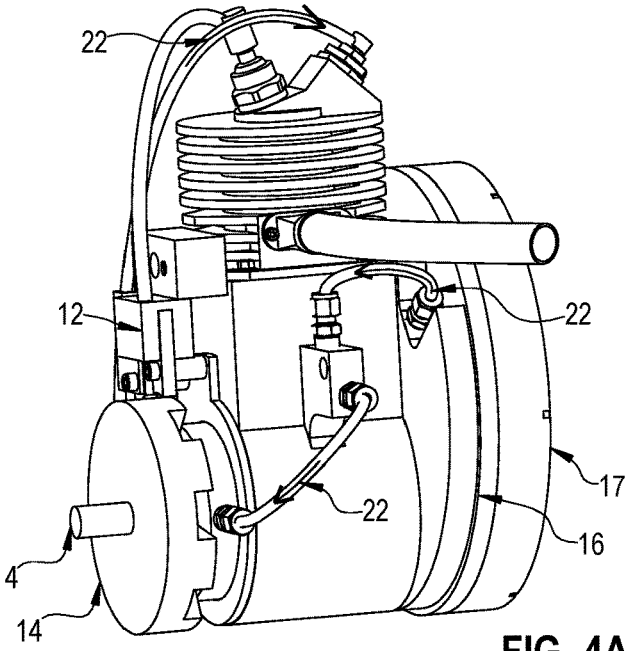
FIG. 4A shows an isometric view of a two-stroke engine and oil flow directions within the hoses.

FIG. 4A is a back isometric view of the engine illustrating the oil view 22 within the hoses. As the shaft 4 and flywheel 14 turns in conjunction with the piston seat 5 and rods 8*m*, the pump bearings 5 and 7 act like a syringe sucking in oil from sump 16 to lubricate all moving components and valve assembly.

FIG. 4B is a front isometric view of the engine with oil sump cover 17 removed to illustrate oil flow inside. Oil suction arm or pipe 19 turns 360 degree to allow the suction head 18 to follow and suck oil at any direction. When the oil sump is at a higher elevation than the engine block, a propeller shape 4*f* on the shaft, as illustrated in FIG. 5, is used to splash 20*s* the oil back up to the sump to be picked up again via 20*i*. One or more holes 16*x* is protruded to allow oil splash 20*s* to fall into the sump and not fall right back into the engine block. Arrows 18*m* illustrate the movement of the oil suction pipe and head as the engine body turns.

FIG. 5 is an exploded view of the one cylinder two-stroke engine illustrating the way the core components are put together. The spark plug 11 and valve assembly 9 are screwed into the cylinder 2. Then Slide the piston 3 into the piston seat 5 with face 3*f* aligned properly to hold and prevent the piston from turning. Face 3*c* should match the face of the intake valve assembly 9. Then slide in the stationary piston 15 into the piston 3 and screw in the base of piston 15 to the cylinder 2. Slide in bearing 7 into the engine block 1 to remain stationary there and to be adjacent to the pump face on piston seat 5, forming a closed cylinder for the oil pump with a hole at the bottom aligned with the openings to check valves 24 mounted in the engine block. Slide and screw in the cylinder assembly into position in the engine block. Slide in the shaft 4 and bearing 4*b* and shaft thrust bearing into the engine block. Slide in a rod 8*m* with its bearings 6*m* on one side, and another rod with its bearings on the other side as illustrated. Stick in each head of the rods into the respective hole in the piston seat. Screw in both rods together to hold and secure the piston, and seat to the shaft. The bearings 6*b* act like a key within the grooves on the shaft and rods securing them in place.

Figure 6:
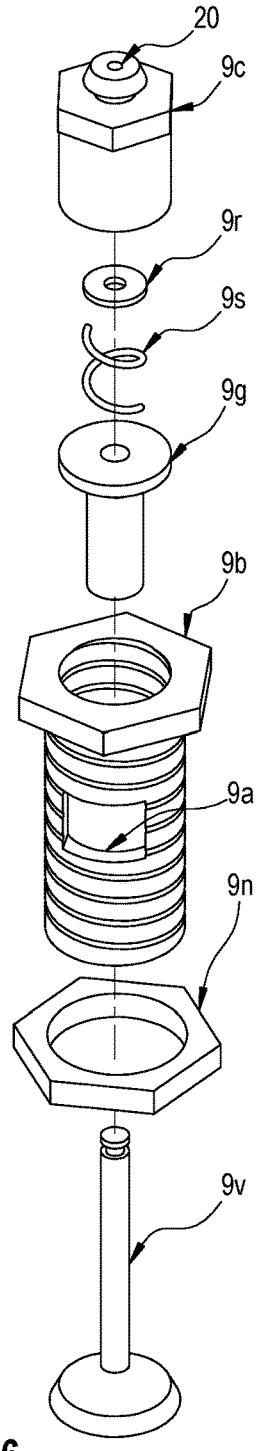
FIG. 6 shows an exploded view of an intake valve assembly.

FIG. 6 is an exploded view of the intake valve assembly. Valve 9*v* is inserted into the nut 9*n* which is used to adjust the height of valve body 9*b* to the cylinder 2. Valve guide 9*g* is inserted into body 9*b* where guide 9*g* is stopped about midway due to smaller diameter in valve body 9*b* to support spring 9*s* and retainer 9*r*. Valve cap 9*c* is screwed in valve body 9*b* allowing the retainer 9*r* to move within. Retainer 9*r* is adapted to seal a chamber within valve cap 9*c* and valve guide 9*g*. A port is located on the valve cap 9*c* to allow compressed air to enter the air chamber around spring 9*s* to spring shut the valve as the working piston moves towards top dead center. Cavity 20 is used to supply lubrication to the vale assembly. Cavity 20 may be located on guide 9*g* in a preferred embodiment. Cavity 9*a* on valve body 9*b* is used to allow compressed intake charge to push valve 9*v* open as soon as pressure within the combustion chamber drops. Valve nut 9*n* is used to lock the valve body 9*b* into the engine block.

Figure 7A:
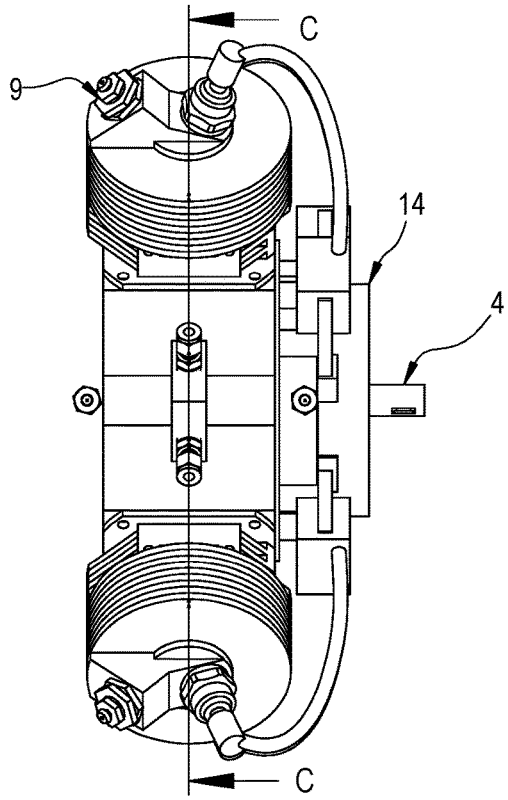
FIG. 7A shows a side view of a two-stroke radial engine.

FIG. 7A illustrates a side view of a radial engine comprising four of the two-stroke cylinders of this present invention.

Figure 7B:
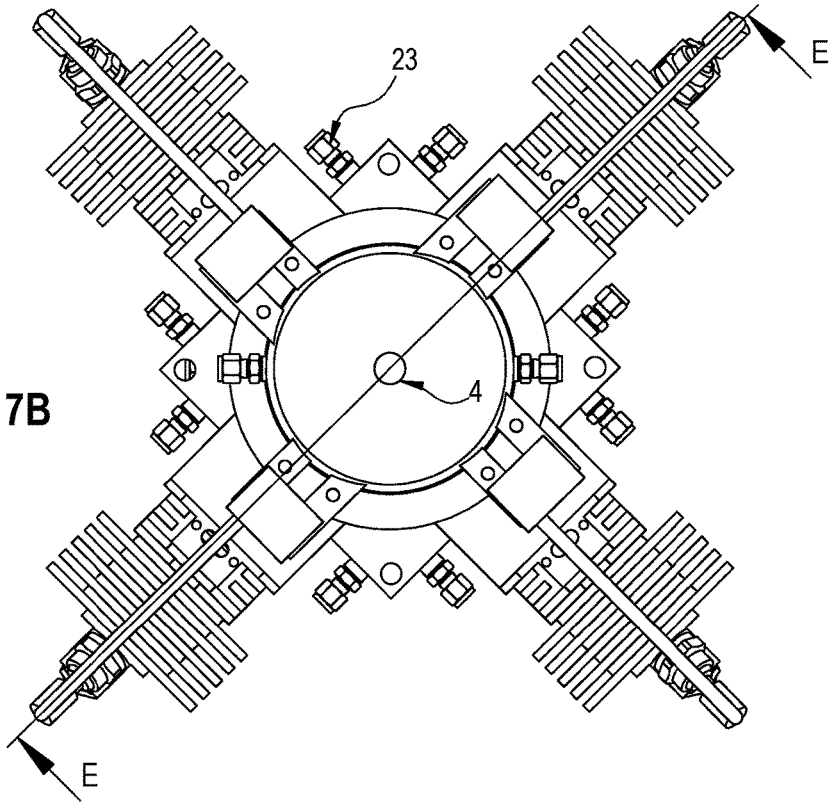
FIG. 7B shows a front view of a two-stroke radial engine.

FIG. 7B illustrates a front view of the radial engine comprising four of the two-stroke cylinders of this present invention.

FIG. 8A illustrates a front section view of the radial engine comprising four of the two-stroke cylinders of the present invention. This figure also illustrates the strokes of the pistons as the engine runs. 20*f* of this figure is an illustration of the oil pump cylinder expanded and full of oil. 20*e* illustrates an oil pump cylinder retracted to the smallest volume displacing oil to the cavities of the check valves.

FIG. 8B illustrates a side section view of the radial engine comprising four of the two-stroke cylinders of the present invention. This figure also illustrates the valve clearance 9*i*. In case of a valve stem failure, the valve will be stopped by the head of the spark plug 11, preventing catastrophic engine failure. This configuration allows the present invention to be a non-interference engine. This figure also illustrates the flow of the intake charge 2*a*. The port 3*s* is aligned with the air intake cavity from the cylinder 2, allowing air intake 2*a* to enter the rear compression chamber when the piston 3 is near Top Dead Center. The port 3*c* is aligned with the opening cavity to the intake valve or transfer ports, when the piston 3 is near Bottom Dead Center. A recycle port may be located near crown of the working piston to allow excessive air charge pressure to recirculate to the intake port. This protects the engine from failure during excessive engine speed since less fuel will enter the combustion chamber due to high pressure within. Exhaust normally has less time to exit the combustion chamber at high speed, causing higher and higher compression ratio. A recycle port will help to save the engine from failure by starving the engine of fuel to keep it running within maximum allowed speed.

Figure 9:
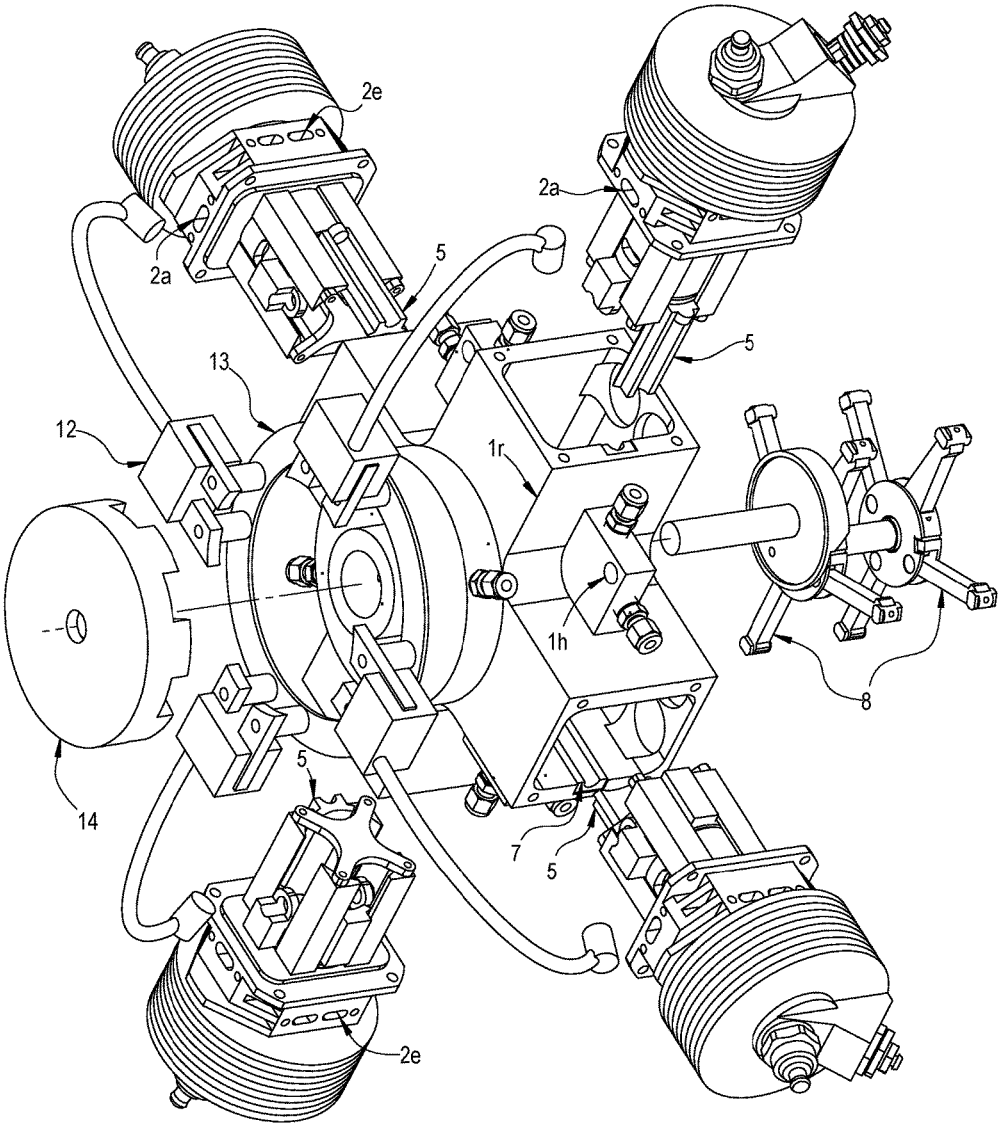
FIG. 9 shows an exploded view of a two-stroke radial engine.

FIG. 9 is an exploded view of the radial engine comprising four of the two-stroke cylinders of the present invention. This drawing also illustrates alternate views and locations of the respective piston seats in relation to the two-stroke cycle. This figure further illustrate the oil pump mechanism made of bearing 5 and bearing 7 which when mated form a closed cylinder. These two bearing also help to redirect the reactive torque from the piston rods. These bearings are well lubricated as they pump oil, and allow for relief during over pressurization should there be a valve failure. 1*h* are mounting support holes for the engine.

Figure 10:
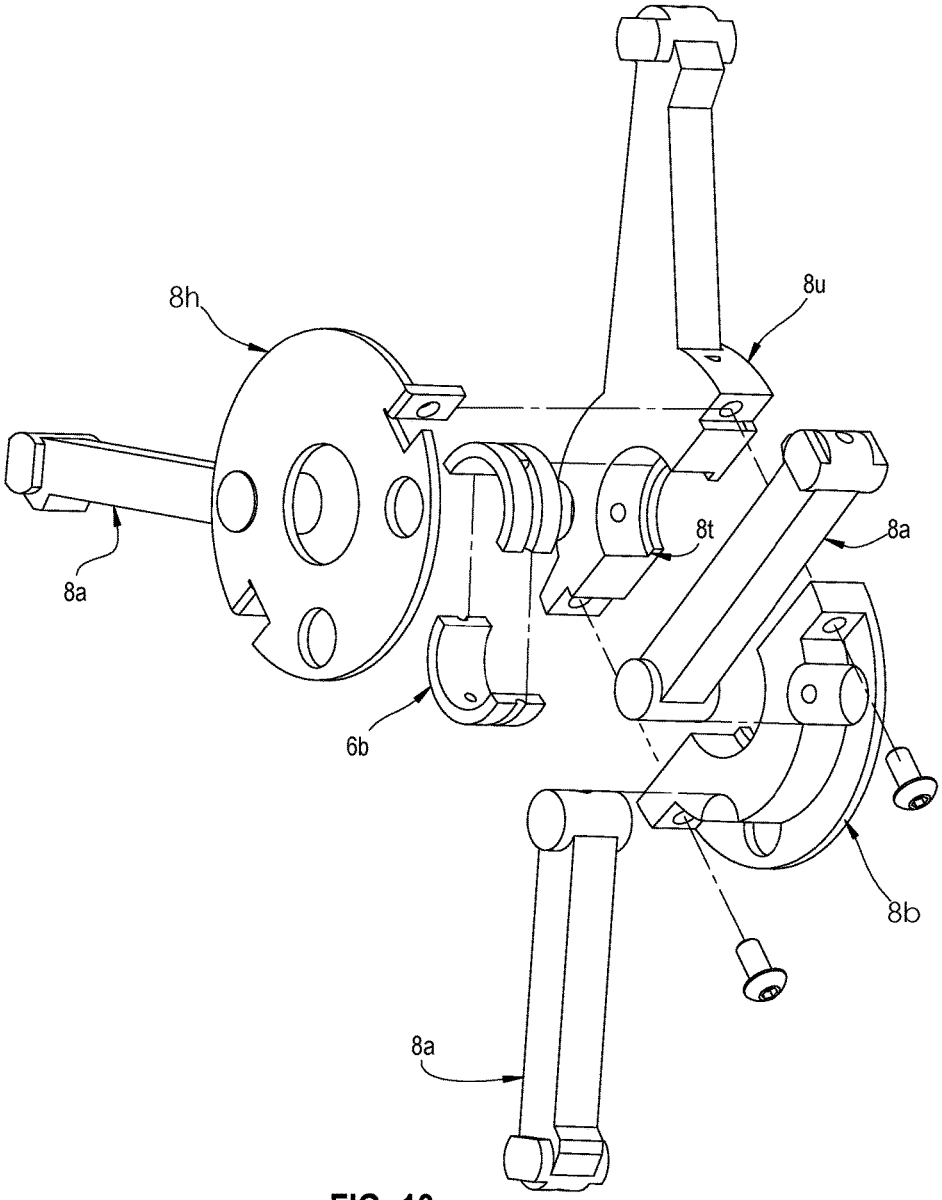
FIG. 10 shows an exploded view of a piston rod assembly.

FIG. 10 illustrates an exploded view of a radial rod assembly. The rod assembly is split into two sections: 8*u* depicts the upper section of the master rod, while 8b shows the lower section of the master rod. Articulated rods 8*a* are used to link piston seats to the shaft. Bearings 6*b* go in between the master rod and the shaft. Protrusion 8*t* and component 8*h* are used to keep the master rod rotatable on the shaft.

The invention claimed is:

1. A two-stroke engine comprising:

a) at least one cylinder in a stationary engine block b) at least one intake valve c) a movable piston functioning within the said cylinder forming a combustion chamber d) a stationary piston functioning within the said movable piston, forming a rear compression chamber e) at least one rod f) a shaft attached to at least one rod g) a piston seat adapted to link the movable piston with the at least one rod wherein at least one top port is located near the crown of the movable piston, and wherein at least one bottom port is located near bottom of the movable piston' skirt, wherein the said at least one bottom port is open to allow a fresh fuel/air mixture to enter the said rear compression chamber to be compressed when the movable piston is near top dead center, wherein the said at least one top port is open when the said movable piston is near bottom dead center to push the compressed air/fuel mixture through the inlet valve into the combustion chamber, wherein the fuel mixture is ignited during compression stroke to push the piston down, wherein exhaust leaves the combustion chamber through exhaust ports located on the cylinder near bottom dead center, wherein the movable piston pushes on the piston seat, which in turn pushes on the rod that turns the shaft.

2. An engine according to claim 1 wherein at least one transfer port may be used in conjunction or in lieu of to the said at least one intake valve.

3. An engine according to claim 1 wherein at least one bearing is mounted on the piston seat and is adapted to glide on the engine block in order to redirect the reaction force from the rods to the engine block.

4. An engine according to claim 1 wherein the bearing mounted on the piston seat and the bearing mounted on the engine block form a closed cylinder with a cavity leading to the at least one check valve, wherein the piston seat moves with the piston to expand and contract the volume of space within the said closed cylinder, wherein the at least one check valve is used to allow oil to be sucked in the said cylinder during expansion, and to allow oil to be pushed out to another channel during contraction of the volume within the said closed cylinder.

5. An engine according to claim 1 wherein a recycle port is located near the crown of the movable piston to allow intake charge to return to the intake port should the pressure within the rear compression chamber be too high due to engine excessive speed, wherein the said recycle port is open late to allow intake charge to be transferred first to the combustion chamber under normal operation.

6. An engine according to claim 1 wherein an oil sump system is used to allow oil to be sucked into an oil pump regardless of the engine body and oil sump rotation comprising:

a) a substantially cylindrical oil sump, b) a propeller blade mounted on the shaft c) a component functioning like an oil pipe pivoting about the axis of the said oil sump d) a rotatable suction head component mounted on the said oil pipe component is adapted to be submerged in the oil sump Wherein oil is sucked from the said suction head through the said oil pipe leading to the oil pump, wherein the said suction head rotates with the oil in the sump due to gravity in order to suck oil, wherein the said propeller is located at about opposite side from the said oil sump, wherein the said propeller shoots oil back up into the said oil sump when the latter is in up position.

* * * * *